US007193564B2

(12) United States Patent
Takagi et al.

(10) Patent No.: US 7,193,564 B2
(45) Date of Patent: Mar. 20, 2007

(54) ANTENNA DEVICE, AND METHOD OF MANUFACTURING THE SAME ANTENNA DEVICE

(75) Inventors: Naoyuki Takagi, Joyo (JP); Setsuo Takesako, Neyagawa (JP); Yoshinobu Nakagawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 11/122,571

(22) Filed: May 5, 2005

(65) Prior Publication Data

US 2005/0264458 A1 Dec. 1, 2005

(30) Foreign Application Priority Data

May 27, 2004 (JP) ..... 2004-157395

(51) Int. Cl.
*H01Q 1/38* (2006.01)

(52) U.S. Cl. ..... 343/700 MS; 343/702

(58) Field of Classification Search ..... 343/702, 343/700 MS

See application file for complete search history.

(56) References Cited

U.S. PATENT DOCUMENTS 6,515,629 B1 * 2/2003 Kuo et al. ..... 343/700 MS
6,724,347 B2 * 4/2004 Tomomatsu et al. . 343/700 MS
6,972,720 B2 * 12/2005 Shikata et al. ..... 343/700 MS
2004/0027298 A1 2/2004 Iguchi et al.
2005/0237260 A1 * 10/2005 Bancroft ..... 343/859

FOREIGN PATENT DOCUMENTS

JP 2003-101335 A 4/2003
WO WO 03/028149 A1 4/2003

* cited by examiner

*Primary Examiner*—Tan Ho
(74) *Attorney, Agent, or Firm*—RatnerPrestia

(57) ABSTRACT

An antenna device includes an electrically insulating base section and a metallic first antenna element fixed to the base section. The first antenna element includes an adjusting section shaped like a ladder or a lattice, which is formed of rails confronting each other and connecting bars which couple a part of the rails. The structure discussed above allows the adjusting section to adjust frequency characteristics corresponding to the antenna element to desirable ones with ease, so that a basic tooling die can be commonly used and standardized antenna device is obtainable with ease.

7 Claims, 11 Drawing Sheets

ANTENNA DEVICE, AND METHOD OF MANUFACTURING THE SAME ANTENNA DEVICE

FIELD OF THE INVENTION

The present invention relates to antenna devices to be mounted to a variety of radio apparatuses such as cellular phones, a method of manufacturing the same antenna devices.

BACKGROUND OF THE INVENTION

A variety of radio apparatuses have been downsized recently. Cellular phones, a typical example of the radio apparatuses, now offer services not only a voice communication but also a data communication such as transmitting and receiving text or video. In the foregoing market situation, performance of antenna devices which transmit and receive radio-wave is one of critical factors determining the specification of the radio apparatuses. The market requires cellular phones to transmit/receive radio-waves of plural frequency-bands sensitively with a single antenna device.

A cellular phones having a conventional antenna device is described with reference to FIGS. 12 and 13. FIG. 12 shows a schematic diagram illustrating a cellular phone to which a conventional antenna device is mounted. FIG. 13 shows a perspective view illustrating an appearance of the conventional antenna device.

As shown in FIG. 12, antenna device 3 to be mounted to a portable radio apparatus is placed in parallel with ground plane 8. Antenna device 3 includes first antenna element 1 (hereinafter called "antenna 1") for resonating with a first frequency and second antenna element 2 (hereinafter called "antenna 2") for resonating with a second frequency. Antenna device 3 is coupled to feeding point 4 placed on ground plane 8, and further coupled to radio circuit 7 via matching circuit 5 and transmission line 6. Radio apparatus 9 is formed of the elements including from antenna device 3 to radio circuit 7 and also ground plane 8.

As shown in FIG. 13, antenna device 13 includes base-section 11 made of electrically insulating resin and shaped like a rectangular parallelepiped. Antenna 1 and meander-shaped antenna 2 are fixed to base-section 11. Antenna 1 has helical coil-section 1A, and antenna 2 is insulated from antenna 1. Both antenna 1 and antenna 2 are commonly fed by feeding point 4.

For the description to proceed, assume that antenna 1 of antenna device 3 thus formed resonates with the frequency band of Global System for Mobile Communications (GSM: 880–960 MHz) and antenna 2 resonates with the frequency band of Digital Communication System (DCS: 1710–1880 MHz).

Reception of a GSM radio-wave at antenna 1 excites a current, which runs through feeding point 4, matching circuit 5, and transmission line 6, then arrives at radio circuit 7, whereby the GSM radio-wave is received.

When a GSM radio-wave is to be transmitted, a signal generated at radio circuit 7 runs through transmission line 6, matching circuit 5, feeding point 4, and arrives at antenna 1, which then excites the signal for radiating. The GSM radio-wave is thus transmitted.

In the case of DCS, antenna 2 receives/transmits the DCS radio-wave via feeding point 4 in the same manner as antenna 1 does.

Conventional antenna device 3 is, e.g. disclosed in Japanese Patent Unexamined Publication No. 2003-101335.

SUMMARY OF THE INVENTION

An antenna device of the present invention includes an electrically insulating base section and a metallic first antenna element fixed to the base section. The first antenna element includes an adjusting section shaped like a lattice or a ladder formed of rails confronting each other and bars coupling parts of the two rails. The forgoing construction allows the adjusting section to adjust frequency characteristics corresponding to the antenna element to desired frequency characteristics with ease, so that a basic tooling die can be commonly used and standardized antenna device is obtainable with ease.

DETAILED DESCRIPTION OF PREFERRED EMBODIMENTS

Exemplary embodiments of the present invention are demonstrated hereinafter with reference to FIG. 1–FIG. 11.

Exemplary Embodiment 1

Figure 1:
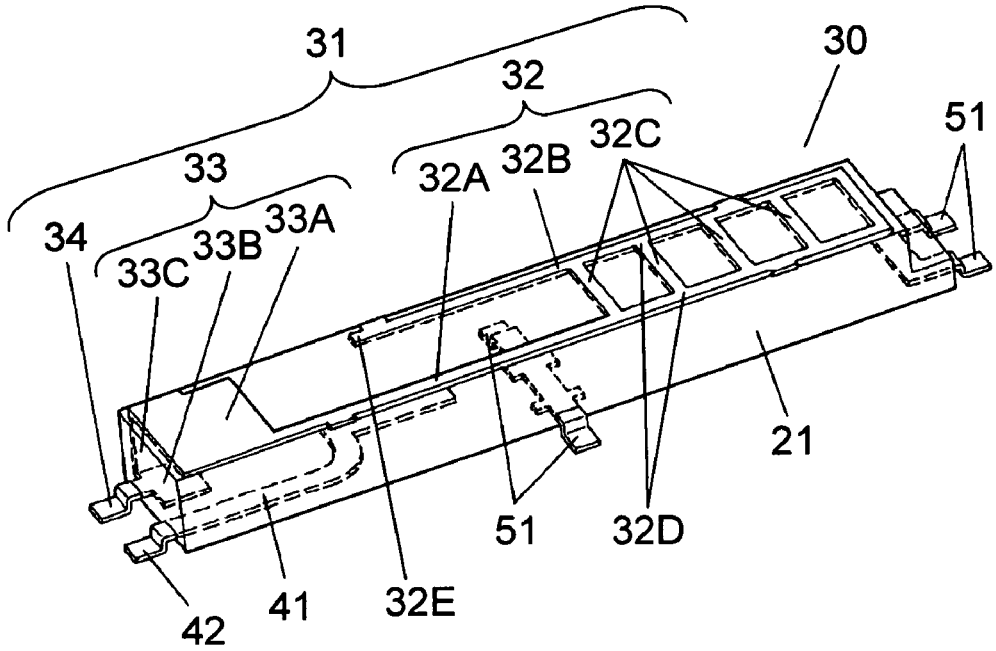
FIG. 1 shows a perspective view illustrating an appearance of an antenna device in accordance with a first exemplary embodiment of the present invention.

FIG. 1 shows a perspective view illustrating an appearance of an antenna device in accordance with the first exemplary embodiment of the present invention. In FIG. 1, base section 21 is formed small enough to be accommodated in a portable radio apparatus (not shown), and molded of resin into a rectangular parallelepiped shape. Base section 21 is molded by putting the resin into a frame formed of first antenna element 31 (hereinafter called "antenna 31") and second antenna element 41 (hereinafter called "antenna 41")

both made of thin metal plate, i.e. insert molding, then the resin molded is fixed to the frame.

Antenna 31 is formed by punching a thin metal plate in a given shape and then bending. Antenna 31 includes adjusting section 32, bent section 33 and first terminal 34 (hereinafter called "terminal 34") unitarily formed with antenna 31. Adjusting section 32 is fixed on a top surface of base section 21. Bent section 33 is U-shape with sharp corner. Terminal 34 protrudes from a lateral face of base section 21.

Adjusting section 32 includes linear rails 32A, 32B and connecting bars 32C that connect rail 32A with rail 32B. Linear rails 32A, 32B are placed on the top surface of base section 21 at the confronting edges and in parallel with each other along the longitudinal direction of base section 21. Plural connecting bars 32C connect rail 32A and rail 32B at joints 32D at right angles to each other. Bars 32C are equidistantly placed. Adjacent bars 32C and rails 32A, 32B between their joints 32D form a loop. In FIG. 1, four loops are formed in antenna device 30.

In the completed antenna device 30 shown in FIG. 1, connecting bars 32C are placed between an intermediate place of the top surface of base section 21 and an end the other side of terminal 34. Bars 32C, linear rails 32A and 32B form a ladder viewed from the top.

The foregoing systematic arrangement of connecting bars 32C allows adjusting antenna device 30 to get desirable frequency characteristics more easily. The arrangement discussed above does not limit the positional relation between linear rails 32A, 32B and connecting bars 32C.

Rail 32B includes one terminal 32E at an intermediate place of base section 21, and terminal 32E has an open end. Rail 32B between terminal 32E and bar 32C nearest to terminal 32E is belt-shaped. A frequency band of the radio-wave available for antenna 31 partially depends on the interval (a length of the open end) between terminal 32E and bar 32C nearest to terminal 32E.

On the other hand, linear rail 32A is coupled to top face section 33A of bent section 33. Adjusting section 32 and top face section 33A expose their surfaces alone from the top surface of base section 21, and rigidly bury themselves along the depth direction into base section 21.

Bent section 33 is formed of top face section 33A, bottom face section 33B confronting top face section 33A, and coupling section 33C which couples top face section 33A and bottom face section 33B. Coupling section 33C is buried in the rear face of base section 21, and bottom face section 33B is rigidly buried in the lower face of base section 21.

Terminal 34 protrudes from bottom face section 33B to the outside at the rear bottom of the left lateral face of base section 21. Terminal 34 is shaped conveniently for antenna device 30 to be surface-mounted, and works as a first feeding point and feeds a current through antenna 31.

Antenna 41 shaped like a belt having a given width is rigidly buried in base section 21 at the lower side. The length of antenna 41 is approx. as half as the longitudinal length of base section 21, and shorter than that of antenna 31. Antenna 41 is open at its first end, and its second end protrudes outside as second terminal 42 (hereinafter called "terminal 42") as shown in FIG. 1. Terminal 42 is shaped conveniently for surface mounting like terminal 34. Both of terminal 34 and terminal 42 are disposed independently of each other on the left lateral side of base section 21. Terminal 42 works as a second feeding point, and feeds a current through antenna 41.

Base section 21 includes dummy terminals 51 (hereinafter called "terminals 51") at the lateral faces other than the left one where terminals 34 and 42 are provided. Terminals 51 are also shaped conveniently for surface mounting.

Antenna device 30 is thus constructed, and respective antennas 31, 41 are mono-pole antennas.

Figure 2:
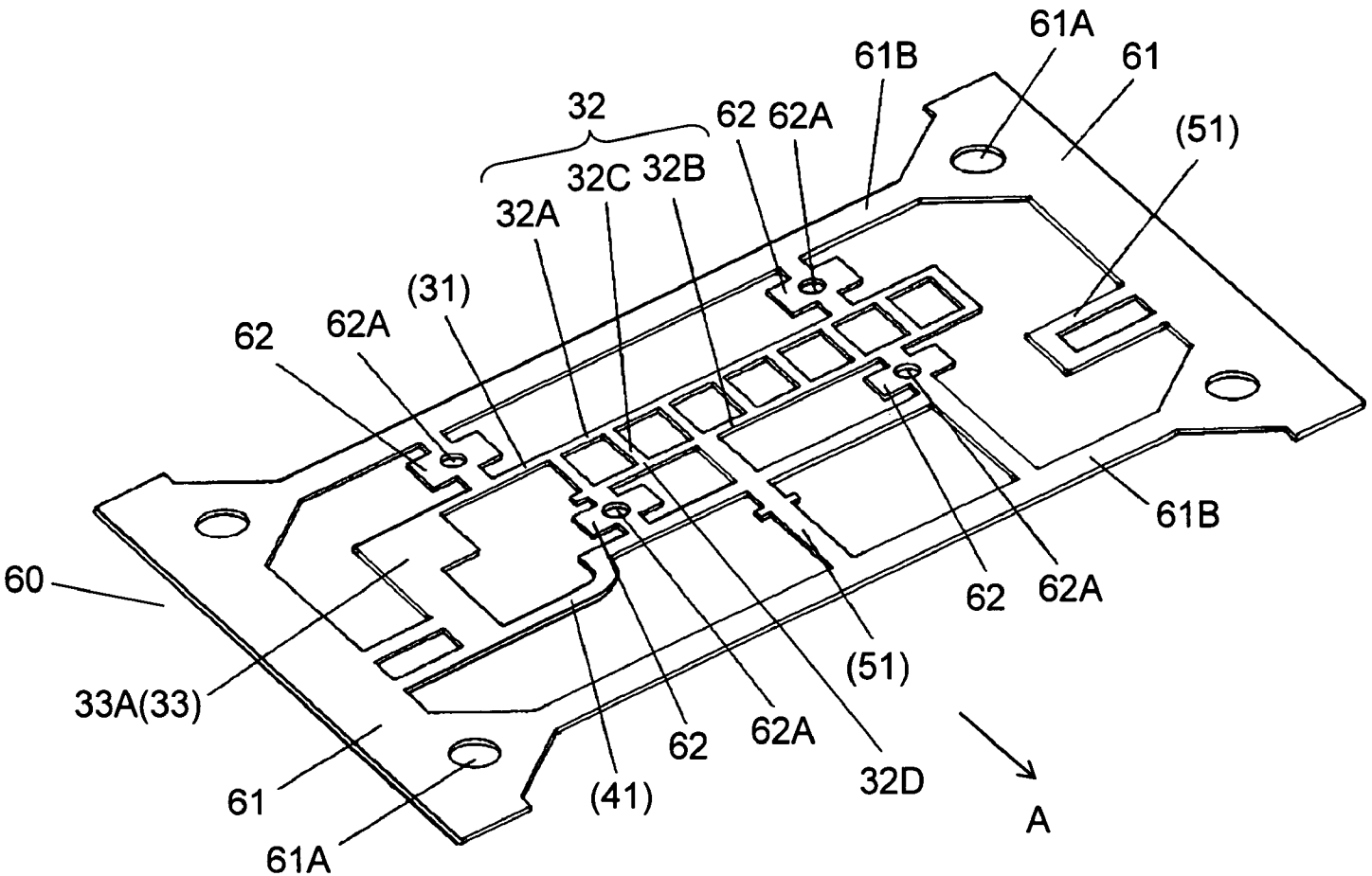
FIG. 2 shows a perspective view illustrating a method of manufacturing the antenna device shown in FIG. 1.

Next, a method of manufacturing antenna device 30 is demonstrated hereinafter with reference to FIG. 2–FIG. 5. First, after punching a hoop-like metal thin plate, hoop 60 is produced. As shown in FIG. 2, carrier rails 61 on both sides of hoop 60 are prepared in parallel with the feeding direction (arrow mark A in FIG. 2). Each one of carrier rails 61 has pilot hole 61A (hereinafter called "hole 61A"). In a given area between both the rails 61, a section to be antenna 31, a section to be antenna 41, and a section to be terminal 51 are placed coplanar. Connecting bars 61B connected between rails 61 are formed outside of the given area. Holes 61A are used for feeding hoop 60 and placed at a given pitch along the longitudinal direction of hoop 60.

In the punching step of forming hoop 60, as shown in FIG. 2, the section to be antenna 31, the section to be antenna 41 and the section to be terminal 51, which will be disposed in base section 21 along a front-to-back direction of base section 21, are unitarily punched, namely, those sections are continued. As such, unitary formation of respective elements allows finishing each one of elements with accuracy. In this step of forming hoop 60, a step of forming antenna 31 and a step of forming antenna 41 are carried out almost simultaneously.

A section to be adjusting section 32 is shaped like a ladder and formed of parallel linear rails 32A, 32B and connecting bars 32C which couple rail 32A and rail 32B at right angles. The length of rail 32B is shorter than that of rail 32A, so that bars 32C are disposed equidistantly and in parallel with each other along the entire length of rail 32B. FIG. 2 shows an example where 8 pieces of bars 32C are formed, so that 7 loops are available.

Linear rail 32A is coupled to connecting bar 61B extending outward of adjusting section 32 via auxiliary bars 62 disposed at two places. Linear rail 32B also extends to another auxiliary bars 62 disposed at two places. First auxiliary bar 62 is coupled to bar 61B extending outward of adjusting section 32, and second auxiliary bar 62 is coupled to the section to be antenna 41. Each one of bars 62 is formed in parallel with the longitudinal direction of hoop 60, and has positioning hole 62A (hereinafter called "hole 62A"). A section to be top face section 33A of bent section 33 (not bent yet in FIG. 2) is coupled to linear rail 32A.

Figure 3:
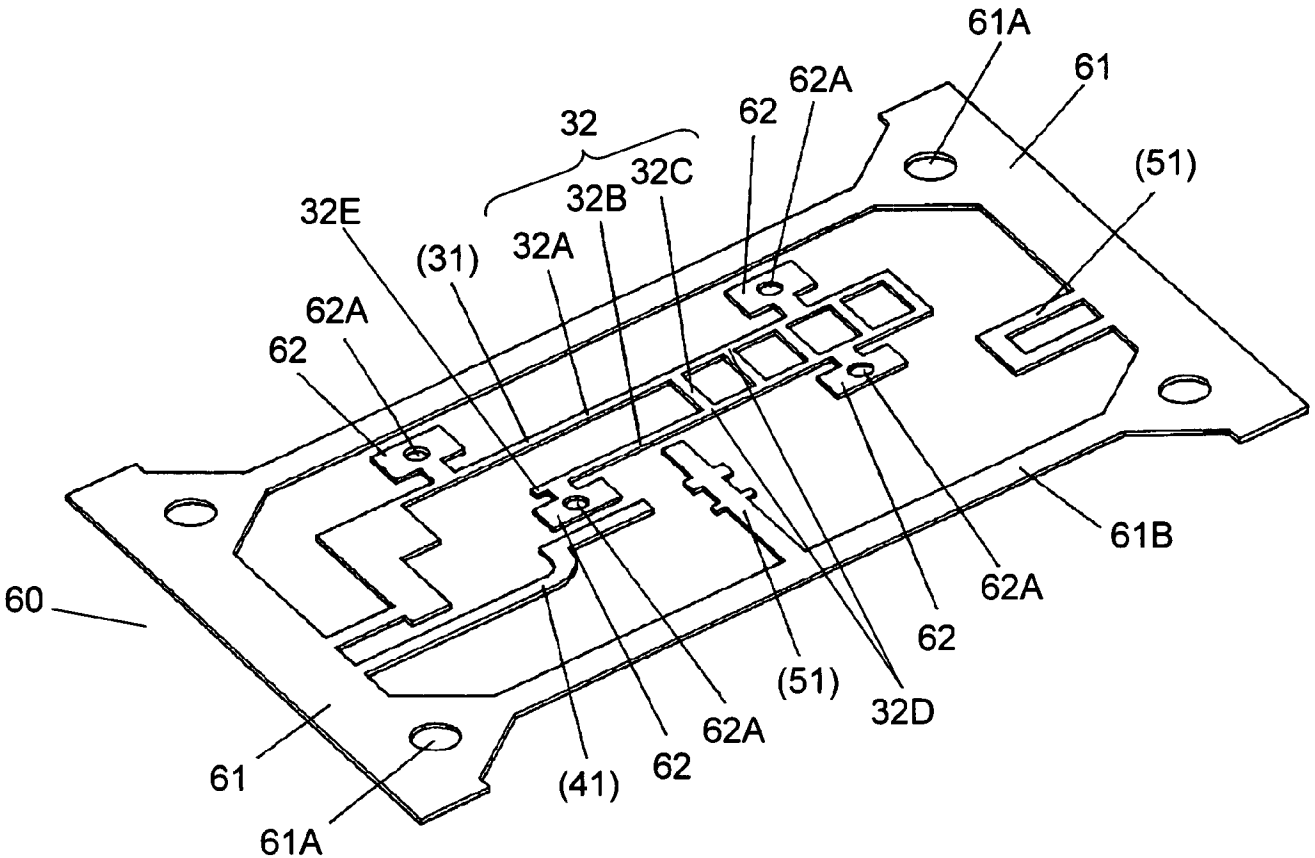
FIG. 3 shows a perspective view illustrating a method of manufacturing the antenna device shown in FIG. 1.

Hoop 60 is fed to the next step, using hole 61A as a reference, and positioned by using holes 61A and 62A. Hoop 60 then undergoes another punching, and auxiliary bars 62 between the section to be antenna 31, the section to be antenna 41, and the section to be terminal 51 are cut out, as shown in FIG. 3. This another punching leaves the foregoing each section connected to bars 61 or 61B with their one end alone. Auxiliary bars 62 are cut out such that a section having hole 62A remains in the section supposed to be antenna 31.

Adjusting section 32 also undergoes the punching together with the foregoing respective sections, namely, adjusting section 32 undergoes an adjusting step. FIG. 3 shows three bars 32C at the center are cut out. This cut-out cuts three loops and leaves them open, and thus four loops remain. If a part (an insert) of this press-punching tooling die is replaceable with another part (another insert) in response to a cutting of adjusting section 32, the tooling die can be used with ease for shapes other than what is discussed above. This will allow a common use of tooling die and a higher efficiency.

Adjusting section 32 is provided with some processes at its given places for antennas 31 and 41 to obtain desirable frequency characteristics, so that given parts of rails 32A and 32B except connecting bars 32C can be cut out. An area between connecting bars 32C can be punched out alternately, or combined bars 32C, rails 32A and 32B, e.g. two consecutive areas can be punched out. Other structures or combinations can be punched out. In other words, the loops available in hoop 60 shown in FIG. 2 can be cut out and left open, i.e. loops having no continuity (non-closed loop) are acceptable. Punch-out of bar 32C makes adjacent two loops one larger loop, this is one of methods of adjusting.

Figure 4:
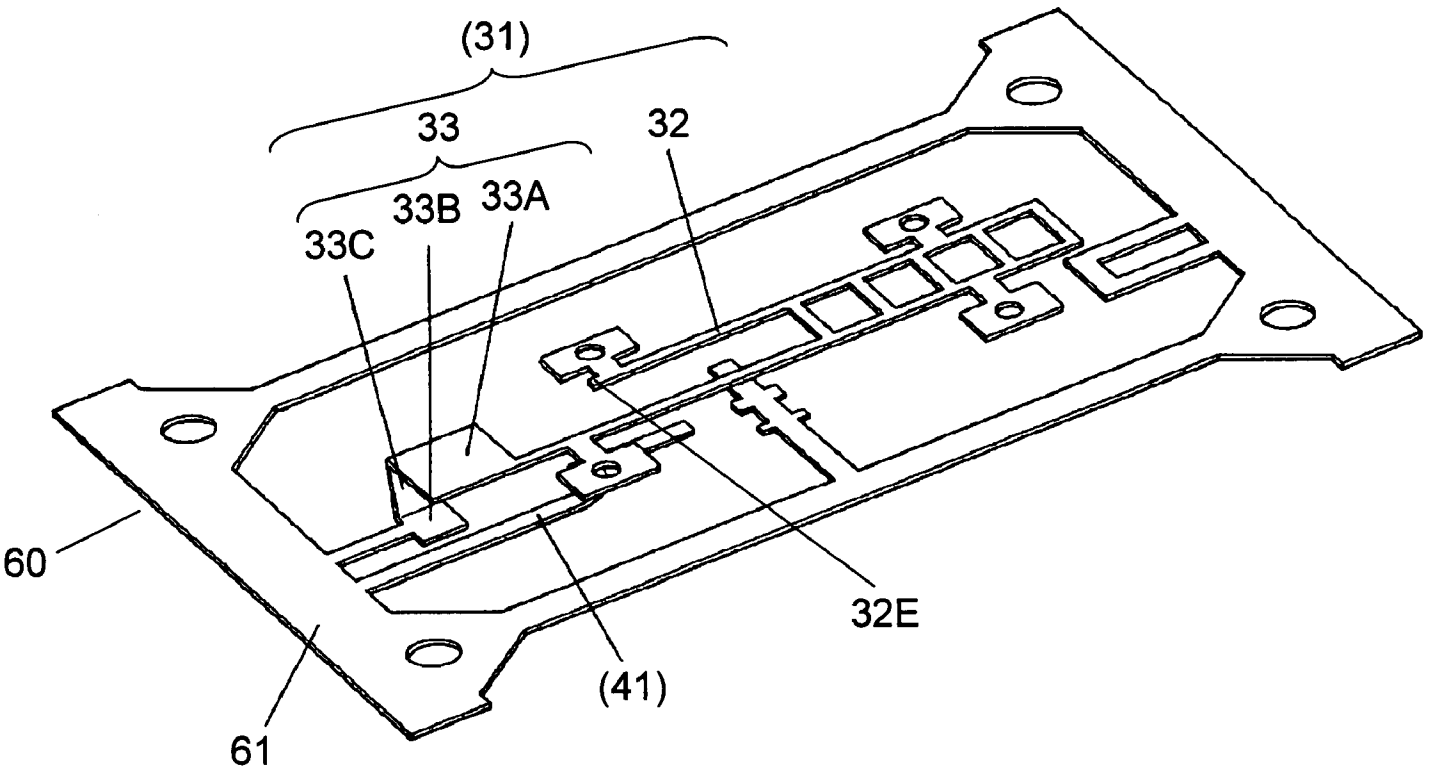
FIG. 4 shows a perspective view illustrating a method of manufacturing the antenna device shown in FIG. 1.
Figure 5:
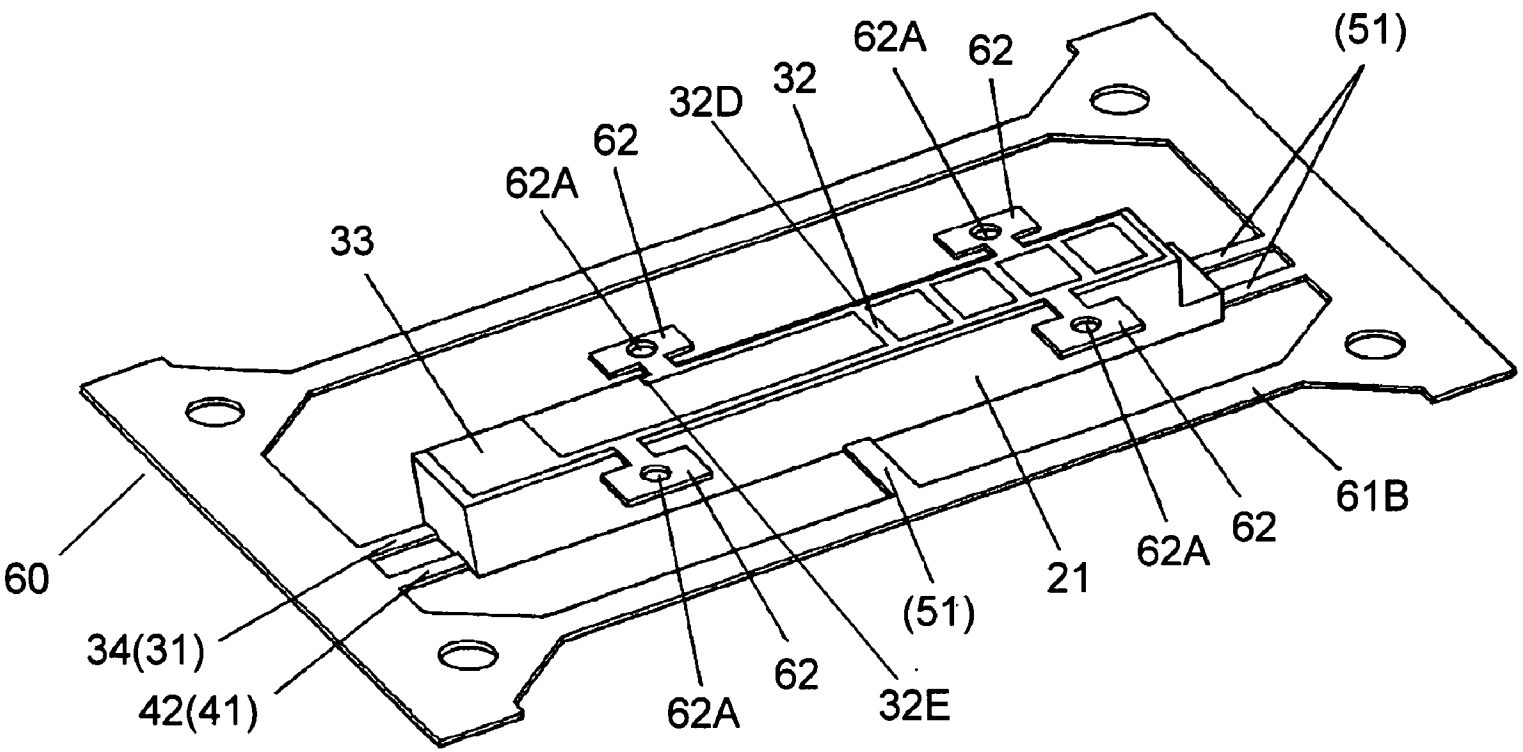
FIG. 5 shows a perspective view illustrating a method of manufacturing the antenna device shown in FIG. 1.

Next is a bending step, as shown in FIG. 4, bent section 33 undergoes the bending step, where bent section 33 is processed such that top face section 33A is coupled to bottom face section 33B with coupling section 33C at a rear part, so that bent section 33 is formed U-shape with sharp corner. Bottom face section 33B connected to carrier rail 61 is bent keeping coplanar with rail 61, and adjusting section 32 coupled with top face section 33A is thus placed over bottom face section 33B.

In the next step of forming the base section, resin is inserted into hoop 60 discussed above, so that base section 21 is formed, and the sections supposed to be antennas 31, 41 are fixed to base section 21. (Refer to FIG. 5.)

In this step of forming base section 21, adjusting section 32 remains to connect to respective auxiliary bars 62 protruding outside, so that adjusting section 32 is positioned by bars 62 and holes 62A during base section 21 is being molded. Base section 21, antennas 31 and 41 can be thus accurately positioned and rigidly molded.

Finally, in a finishing step, respective auxiliary bars 62 are cut out from adjusting section 32, and carrier rails 61 and connecting bars 61B are cut and separated from base section 21. Then sections coupled to rails 61 and bars 61B are bent to be terminals 34, 42, and 51. Antenna device 31 as shown in FIG. 1 is thus completed.

As discussed above, this manufacturing method does not require antenna device 30 changing its external form, and a part (an insert) of tooling die for the adjusting section 32 can be replaced with another part (another insert), so that the punch-out of adjusting section 32 can be changed, which allows antenna device 30 to obtain desirable frequency characteristics. As a result, the basic tooling die can be commonly used, and standardized antenna device 30 is obtainable with ease.

Figure 6:
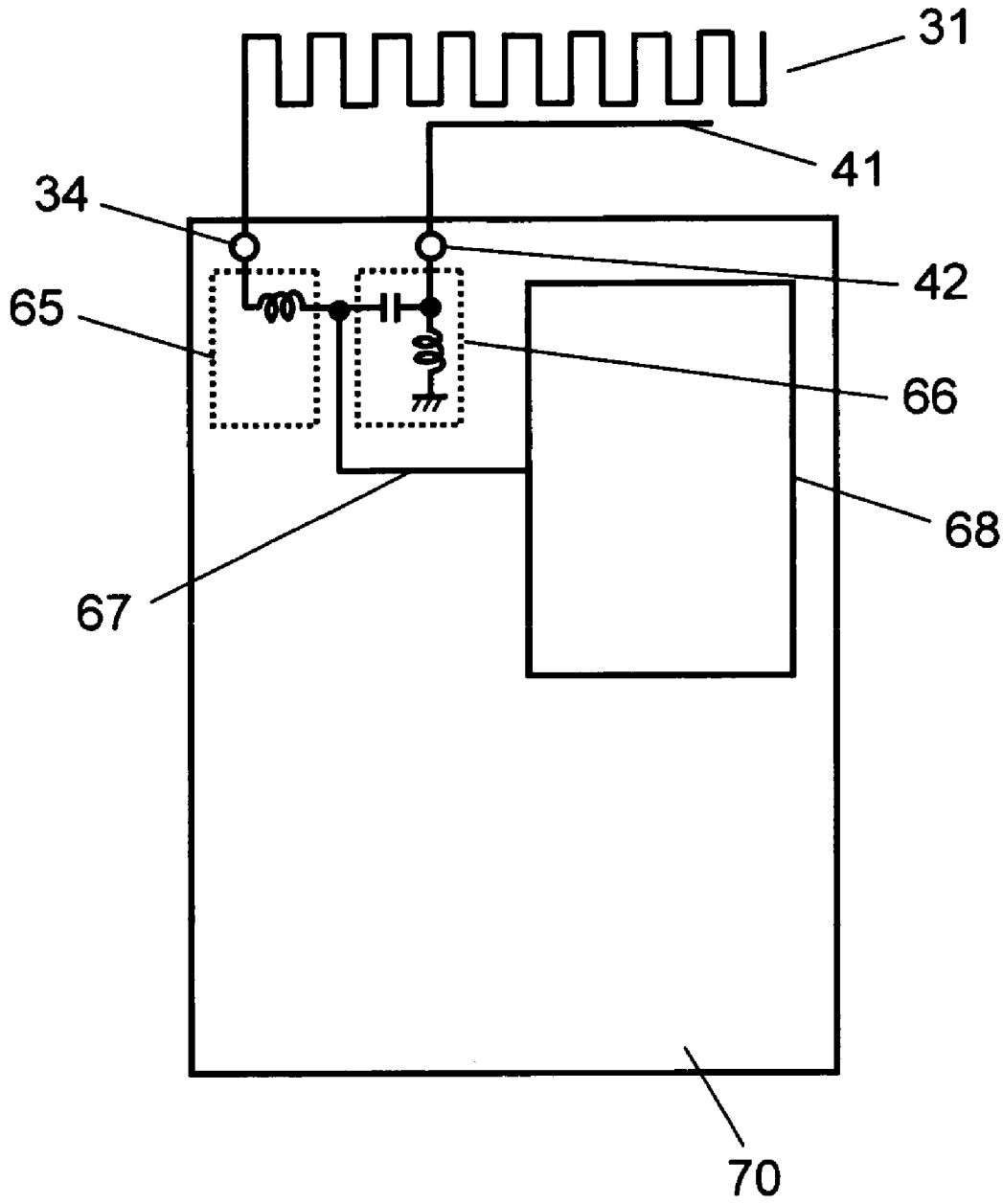
FIG. 6 shows a schematic diagram illustrating a cellular phone to which the antenna device shown in FIG. 1 is mounted.

Antenna device 30 includes terminals 34 and 42 which work as feeding points respectively to antennas 31 and 41. This structure allows antenna 31 and antenna 41 to be coupled, as shown in FIG. 6, independently to circuits of an apparatus to which antenna device 30 is mounted.

Antenna device 30 is mounted to the apparatus such that terminal 34 is coupled to first matching circuit 65 (hereinafter called "circuit 65") and terminal 42 is coupled to second matching circuit 66 (hereinafter called "circuit 66") different from circuit 65. Circuits 65, 66 are coupled to radio circuit 68 via transmission line 67. Those circuits 65, 66, 68 and line 67 are prepared in the apparatus to which antenna device 30 is mounted.

Since antennas 31, 41 are independently coupled to radio circuit 68, frequencies available to each antenna can be fine-tuned by circuit 65 or circuit 66 individually. As a result, frequencies corresponding to antennas 31, 41 can be finely and accurately tuned.

In antenna device 30, antenna 31 is longer than antenna 41, so that antenna 31 resonates with the frequency band of GSM (880–960 MHz) and antenna 41 resonates with the frequency band of DCS (1710–1880 MHz) or that of Personal Communication Services (PCS: 1850–1990 MHz) is higher than the frequency band dealt with antenna 31. As such, different frequencies can be assigned to antenna 31 and antenna 41 respectively, so that this structure is substantially useful for antenna devices.

Figure 7A:
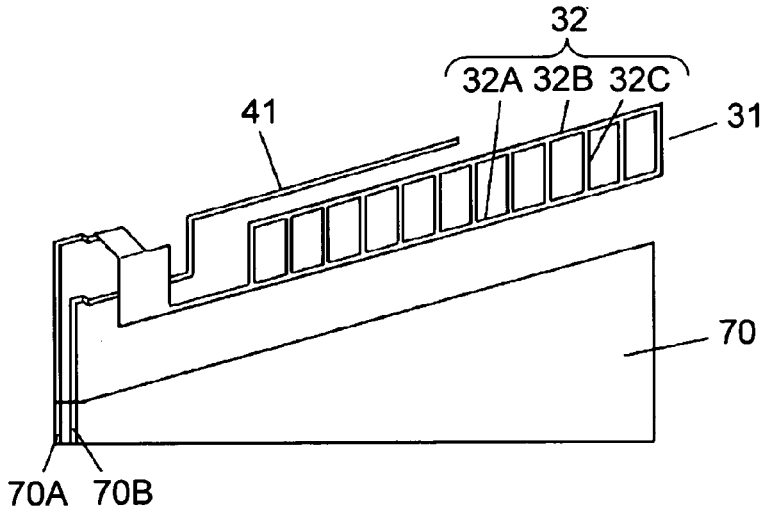
FIG. 7A–FIG. 7C show simulation models of the antenna device in accordance with the first exemplary embodiment of the present invention.

Change of frequency characteristics is simulated with a parameter of punching-out the ladder-like adjusting section 32. FIG. 7–FIG. 10 show the simulation result. FIG. 7A shows a perspective view of a simulation model where no connecting bars are punched out at all.

As shown in FIG. 7A, in the simulation model, antennas 31 and 41 are placed at a given distance from ground plane 70, and transmission line 70A, 70B provided to ground plane 70 are electrically coupled to antennas 31, 41 respectively.

Adjusting section 32 is formed of linear rails 32A, 32B, and 12 pieces of connecting bars 32C equidistantly placed between rails 32A and 32B, so that 11 pieces of loops are formed. Rails 32A, 32B and bars 32C form a ladder-like shape. Adjusting section 32 confronts antenna 41 as described in the description of the foregoing antenna device 30, and other structures remain unchanged from those of the foregoing antenna device 30. Descriptions of the other structures are thus omitted here.

Figure 7B:
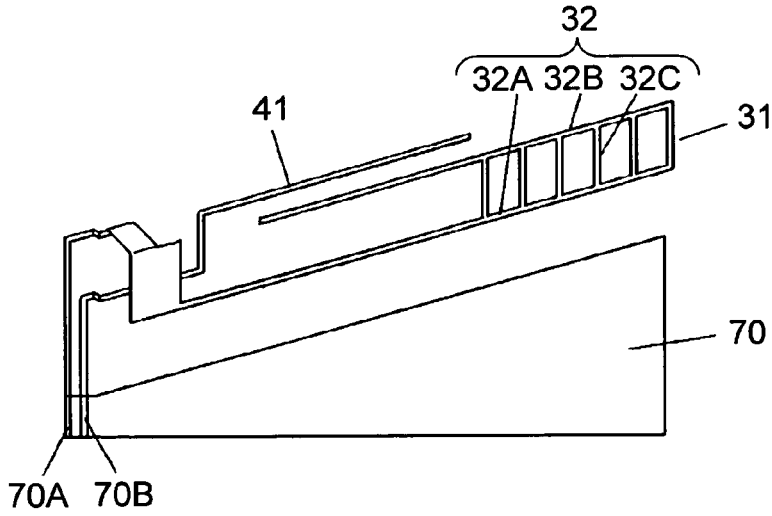
Figure 7C:
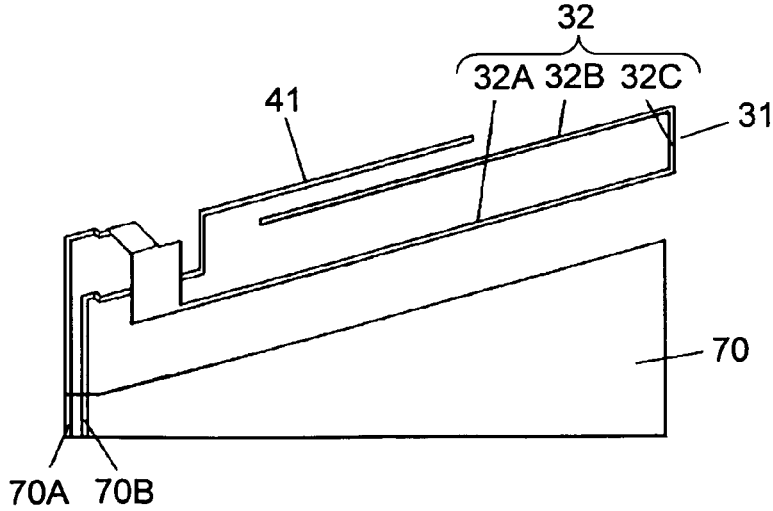

FIG. 7B shows a perspective view of another simulation model where 6 pieces of bars 32C are punched out, so that 5 pieces of loops remain. FIG. 7C shows a perspective view illustrating still another simulation model where 11 pieces of bars 32C are punched out and all the loops are cut and left open.

Figure 8:
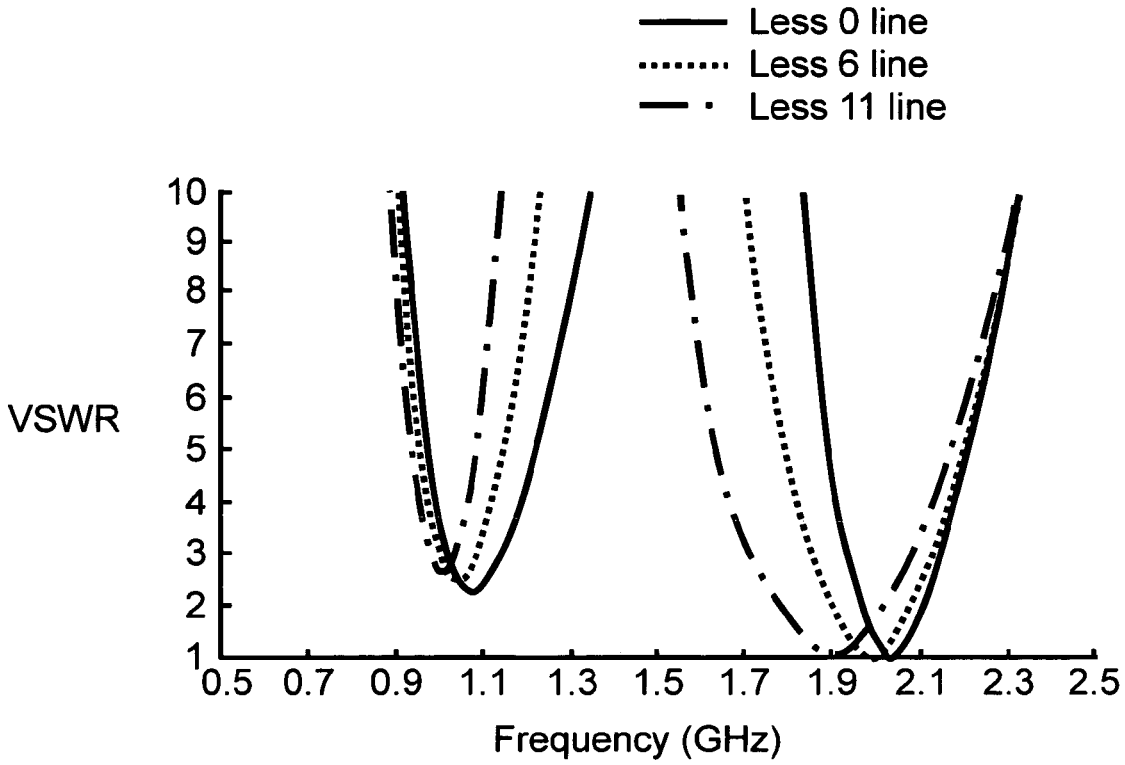
FIG. 8 shows frequency characteristic diagram corresponding to the simulation models shown in FIG. 7A–FIG. 7C.

FIG. 8 shows frequency characteristic diagram in response to the respective simulation models shown in FIG. 7A–FIG. 7C. In FIG. 8, X axis represents frequencies and Y axis represents VSWR, i.e. index of impedance matching. Solid lines show the results of simulation model shown in FIG. 7A, broken lines show the results of model shown in FIG. 7B, and alternate long and short dash lines show the results of model shown in FIG. 7C. FIG. 8 tells that the respective models have two resonance points where VSWR takes a minimum value. The resonance points at the lower frequency correspond to antenna 31, and the resonance points at the high frequency correspond to antenna 41.

As FIGS. 7A, 7B and 7C tell sequentially, connecting bars 32C are punched out step by step, and this process proves that the center of resonance frequency moves to the lower frequencies as shown in FIG. 8. The resonance frequency band of antenna 41 moves to the lower and becomes broader as the number of loops decreases.

This is because of the following theory: An increase in the number of punched-out bars 32C prolongs a length of linear rail 32B between terminal 32E and remaining bar 32C, so that electric charges tend to concentrate. Capacity coupling formed between open end of antenna 31 and antenna 41 thus increases.

Antenna device 30 discussed above has the structure, where connecting bars 32C are punched out step by step along a given direction, so that available frequencies of two antennas 31, 41 can be moved to lower frequencies simultaneously. In other words, the available frequencies of antennas 31, 41 are adjustable simultaneously.

Equidistant arrangement of connecting bars 32C allows estimating with ease the status of frequency transition of antennas 31, 41, and this structure is preferable, however; bars 32C are not necessarily placed equidistantly.

Additional process on adjusting section 32 will move lower frequencies available to antennas 31, 41. For instance, antenna 31, 41 are initially adjusted at frequencies slightly higher than their desirable frequencies, then the resonance points are lowered by cutting off bars 32C so that the antennas can be adjusted to the desirable frequencies more easily.

As discussed above, according to this first embodiment, surface-mounting type antenna device 30 is obtainable with ease. This antenna device 30 allows a simple adjustment of frequencies available thereto, and allows itself to be standardized.

In this embodiment, antenna device 30 having two antenna elements 31, 41 is described. However, the method discussed above is applicable to an antenna device having antenna 31 alone including adjusting section 32, or an antenna device including three or more than three antenna elements. In other words, punch-out of some bars 32C of adjusting section 32 allows a simple adjustment of frequency characteristics of the different type of antenna devices from those discussed above.

In this embodiment, the loops are shaped like a square formed of connecting bars 32C, linear rails 32A and 32B; however, the loops can be in any shape as long as it is a closed loop. For instance, annular loop, oval loop, ellipse loop or polygonal loop can have an advantage similar to what is discussed previously.

The punch-out of bars 32C leaves some burrs on the lateral faces of adjusting section 32; however, those burrs do not adversely affect the function of antennas 31, 41.

Exemplary Embodiment 2

The second embodiment includes adjusting section 32 shaped like a meander. The second embodiment is demonstrated hereinafter with reference to FIG. 9 and FIG. 10. The second embodiment differs from the first one in the method of punching out parts of adjusting section 32, so that structural elements similar to those in the first embodiment have the same reference marks and detailed descriptions thereof are omitted here. In this second embodiment, the description is focused on simulated transition of frequency characteristics.

Figure 9A:
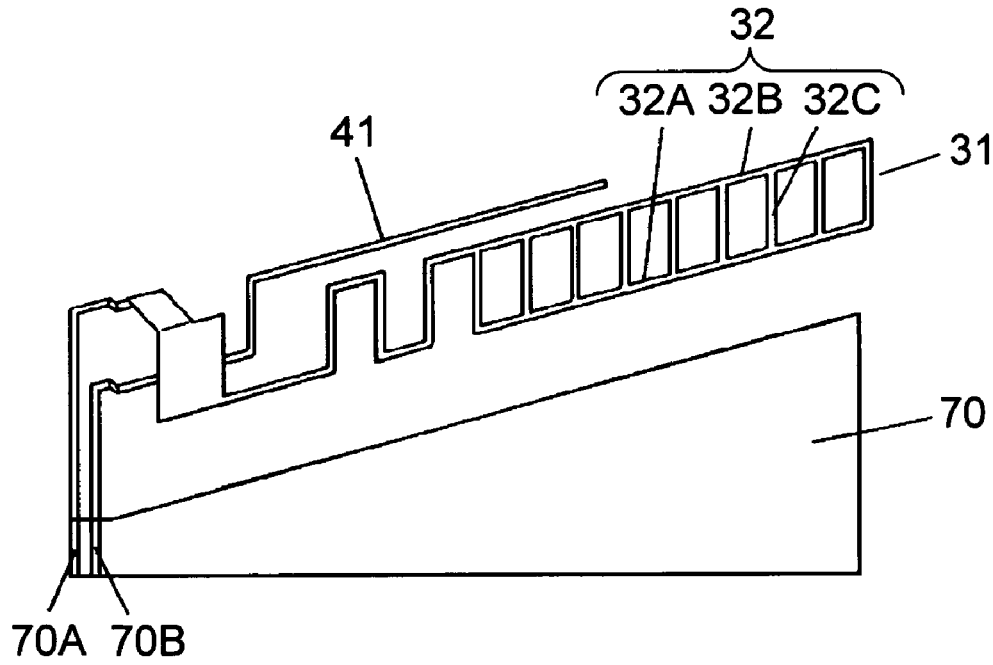
FIG. 9A and FIG. 9B show simulation models of the antenna device in accordance with a second exemplary embodiment of the present invention.
Figure 9B:
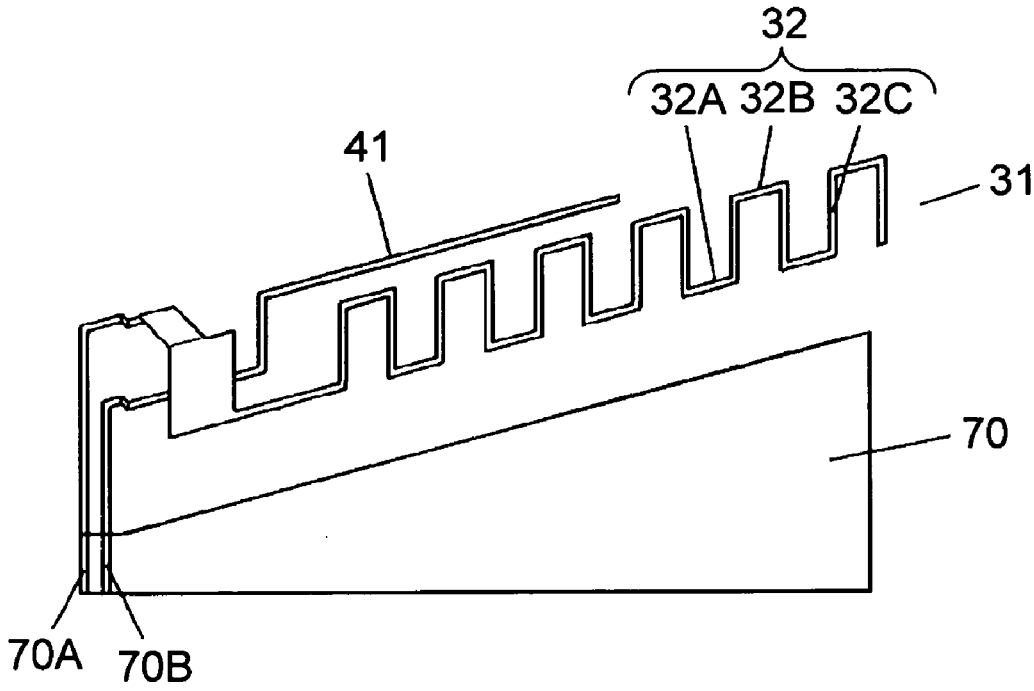

FIG. 9A shows a perspective view illustrating an appearance of a simulation model where linear rails 32A, 32B are partially and alternately punched out at 3 places from the model shown in FIG. 7A so that the center of adjusting section 32 shapes like a meander, and 8 pieces of loops remain. FIG. 9B shows a perspective view illustrating an appearance of a simulation model where linear rails 32A, 32B are partially and alternately punched out from the model shown in FIG. 7A, and all the loops are cut and left open.

Figure 10:
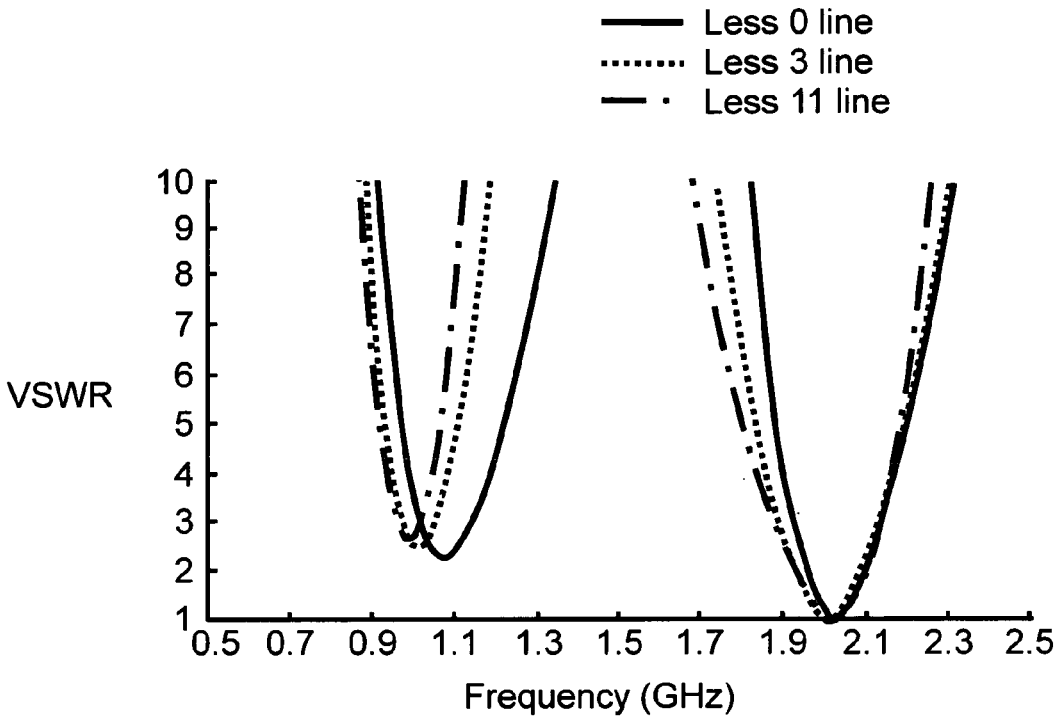
FIG. 10 shows frequency characteristic diagram corresponding to the simulation models shown in FIG. 7A, FIG. 9A, and FIG. 9B.

FIG. 10 shows frequency characteristic diagram in response to the respective simulation models shown in FIGS. 7A, 9A and 9B. X-axis and Y-axis represent frequencies and VSWR as same as FIG. 8 does. In FIG. 10, solid lines show the results of model shown in FIG. 7A, broken lines show the results of model shown in FIG. 9A and alternate long and short dash lines shows the results of model shown in FIG. 9B.

In the case of the models shown in FIGS. 9A and 9B, the resonance points at the lower frequencies further move to lower frequencies with respect to the model shown in FIG. 7A. A longer meander of the models shown in FIGS. 9A and 9B make a virtual effective antenna longer than that of the model shown in FIG. 7A. In other words, the resonance point at the lower frequency available to antenna 31 varies in response to the punching out of adjusting section 32.

At the same time, the capacity coupling formed between antennas 31 and 41 decreases step by step, so that the resonance frequency band of antenna 41 becomes broader toward the lower frequencies as the length of meander becomes longer.

The simulation models shown in FIGS. 7C and 9B have all the loops been cut and left open; however, the statuses of open loops differ from each other, thereby producing different results in variation of frequencies available to the respective models. A comparison of those two models reveals a significant difference in the resonance point at high frequencies available to antenna 41, namely, the capacity coupling status between antennas 31 and 41 greatly affects the frequency available to the antennas.

As discussed above, the capacity coupling status between antennas 31 and 41 is taken into consideration, and at the same time, some parts of adjusting section 32 are cut off for adjusting the frequency characteristics. This method of adjusting frequency characteristics is substantially simpler than a conventional one that involves changes in coil sections, so that an antenna can be designed more efficiently. On top of that, adjusting section 32 needs no change in size, and cutting off given places alone allows adjusting the frequency characteristics available to the antenna, so that antenna devices can be standardized with ease.

The antenna device in accordance with the second embodiment has a structure of which adjusting section 32 is shaped like a meander by cutting off linear rails 32A and 32B alternately. In other words, the cut-off of adjusting section 32 is not always the cut-off of connecting bars 32C.

Exemplary Embodiment 3

Figure 11:
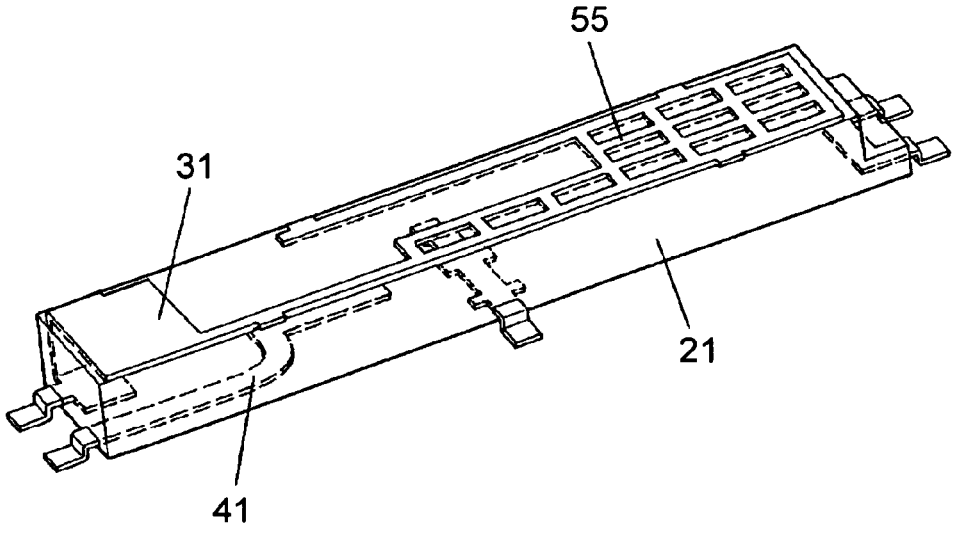
FIG. 11 shows a perspective view illustrating an appearance of an antenna device including an adjusting section in accordance with a third exemplary embodiment of the present invention.
Figure 12:
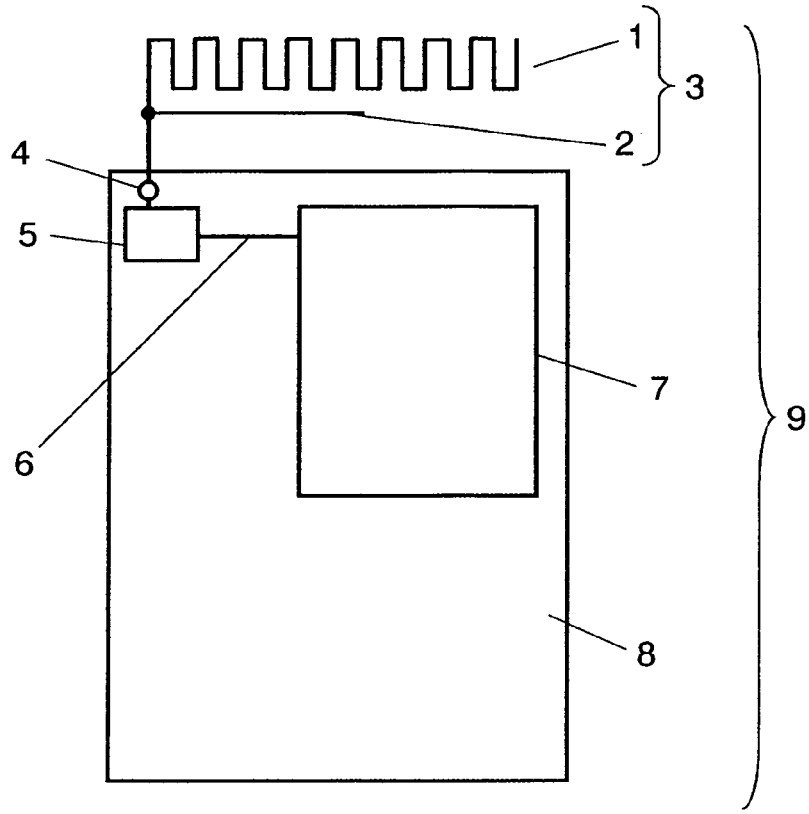
FIG. 12 PRIOR ART
FIG. 12 shows a schematic diagram of a cellular phone to which a conventional antenna device is mounted.
Figure 13:
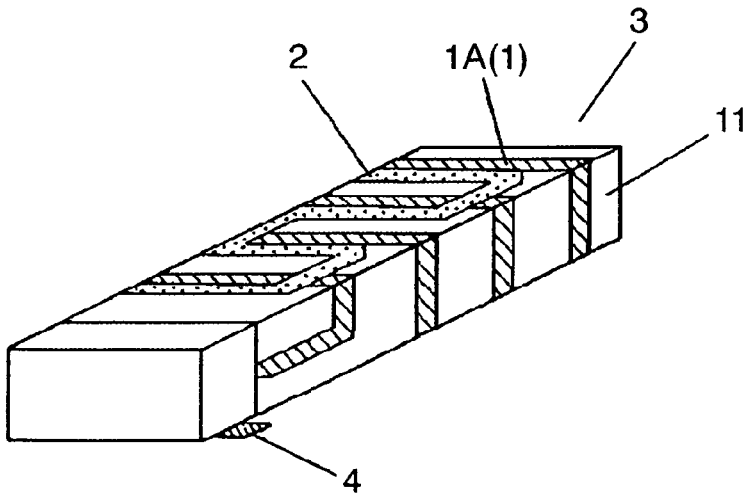
FIG. 13 PRIOR ART
FIG. 13 shows a perspective view illustrating an appearance of the conventional antenna device.

The third embodiment of the present invention is demonstrated hereinafter with reference to FIG. 11, which shows a lattice like adjusting section instead of a ladder like one.

Lattice-like adjusting section 55 allows more elaborate punch-out than ladder like adjusting section 32 does. As shown in FIG. 11, halting the punch out of connecting bars halfway will leave some lattices, so that the finer adjustment can be expected.

The lattices equidistantly arranged allow estimating the frequency characteristics with ease; however, the structure is not limited to the equidistant arrangement. Adjusting sections 32 and 55 are not limited to the ladder-like shape or lattice-like shape.

What is claimed is:

1. An antenna device comprising:

a base section made of electrically insulating resin; and a first antenna element, made of metal and fixed to the base section, including an adjusting section shaped in one of a ladder and a lattice, wherein the ladder and the lattice are formed of rails confronting each other and connecting bars which couple a part of the rails, the rails and the connecting bars forming a plurality of closed loops.

2. The antenna device of claim 1, wherein one of the rails extending from the adjusting section of the first antenna element has an open end, wherein the antenna device further comprises a second antenna element fixed to the base section and capacitively coupled with the first antenna element.

3. A method of manufacturing an antenna device comprising:

forming a first antenna element which is made of metal and includes an adjusting section shaped in one of a ladder and a lattice, wherein the ladder and the lattice are formed of rails confronting each other and connecting bars which couple a part of the rails; and adjusting frequency characteristics corresponding to the first antenna element by cutting off a part of the adjusting section.

4. The method of manufacturing an antenna device of claim 3 further comprising:

forming a second antenna element to be capacitively coupled with the first antenna element, wherein the adjusting is done by cutting off a part of the adjusting section in response to a capacity coupling between the first antenna element and the second antenna element for adjusting frequency characteristics corresponding respectively to the first antenna element and the second antenna element.

5. The method of manufacturing an antenna device of claim 4, wherein the adjusting is done by:

cutting off a part of the connecting bars such that the first antenna element has an open end at one of the rails extending from the adjusting section for increasing the capacity coupling between the first antenna element and the second antenna element, so that respective resonance frequencies of the first antenna element and the second antenna element are changed to lower frequencies for adjustment.

6. The method of manufacturing an antenna device of claim 4, wherein the adjusting is done by:

cutting off a part of the adjusting section for forming a meander-shaped section, so that frequency characteristics corresponding respectively to the first antenna element and the second antenna element are adjusted.

7. An antenna device comprising:

a base section made of electrically insulating resin; and a first antenna element, made of metal and fixed to the base section, including an adjusting section shaped in one of a ladder and a lattice, wherein the ladder and the lattice are formed of rails confronting each other and connecting bars which couple a part of the rails, wherein one of the rails extending from the adjusting section of the first antenna element has an open end, and wherein the antenna device further comprises a second antenna element fixed to the base section and capacitively coupled with the first antenna element.

* * * * *